United States Patent [19]

Appleton

[11] Patent Number: 4,545,432

[45] Date of Patent: Oct. 8, 1985

[54] DEVICE FOR RETRIEVING OBJECTS FROM WELLS

[76] Inventor: Robert P. Appleton, Glenburn House, Tornaveen, Nr. Torphins, Aberdeenshire, Scotland

[21] Appl. No.: 721,313

[22] Filed: Apr. 9, 1985

Related U.S. Application Data

[63] Continuation of Ser. No. 558,167, Dec. 5, 1983, abandoned.

[30] Foreign Application Priority Data

Dec. 16, 1982 [GB] United Kingdom ..... 8235836

[51] Int. Cl.[4] ..... E21B 31/08

[52] U.S. Cl. ..... 166/99; 175/250; 294/86.11

[58] Field of Search ..... 166/99, 301, 107–109, 166/162–165; 294/86.11, 86.34, 68; 175/244, 308, 250

[56] References Cited

U.S. PATENT DOCUMENTS 2,266,739 12/1941 Cooper ..... 294/86.11
2,709,617 5/1955 Lang ..... 175/250
2,977,147 3/1961 Cooper ..... 294/86.11

FOREIGN PATENT DOCUMENTS 0817209 3/1981 U.S.S.R. ..... 294/86.11

*Primary Examiner*—Stephen J. Novosad
*Assistant Examiner*—Thuy M. Bui
*Attorney, Agent, or Firm*—Bell, Seltzer, Park & Gibson

[57] ABSTRACT

A wash-over type down hole retrieving device or fishing tool is described, consisting of a hollow cylindrical body having an open lower end. The body has concentric inner and outer walls, defining an annular space in which an annular piston can force down an annular sleeve of a malleable alloy having downwardly extending finger-like formations. The inside of the lower end of the outer wall is of cupped configuration effective to deflect the fingers inwards and over the open end of the body so as to trap and retain an object for retrieval. The annular piston is forced down hydraulically by dropping a diverter ball valve. Cutting teeth are optionally provided on the outer periphery of the lower end of the outer wall, on a detachable shoe.

5 Claims, 8 Drawing Figures

DEVICE FOR RETRIEVING OBJECTS FROM WELLS

This application is filed under the provision of 35 U.S.C. 120 as a continuation application from copending application Ser. No. 558,167, filed Dec. 5, 1983, now abandoned.

This invention relates to a retrieving device for use in retrieving objects from wells.

In the art of constructing retrieving devices or "fishing tools" the operational success rate has hitherto been low due particularly to difficulty in finding a reliable way of securing or trapping an object or objects once it is or they are within the tool.

An object of the present invention is to provide a retrieving device in which the aforesaid difficulty is obviated or mitigated.

According to the present invention, there is provided a retrieving device for use in retrieving objects from wells, comprising a body of generally hollow cylindrical configuration, means defining an open end of the body giving access to the interior of the body, a head portion of the body disposed opposite the said open end, a hollow cylindrical wall extending from said head portion concentrically within said body and defining therewith an annular space, a sleeve member in said annular space, finger-like elements formed on said sleeve member and directed towards said open end, the finger-like elements being of a malleable material, the sleeve together with the finger-like elements being free to rotate with respect to the body, forcing means for forcing the sleeve together with the finger-like elements towards the said open end, and deflecting means within the body adjacent the open end for deflecting the finger-like elements inwards, a free end of said hollow cylindrical wall being disposed adjacent said deflecting means for cooperating with the deflecting means to effect permanent closure formation of the finger-like elements.

An embodiment of the present invention will now be described, by way of example, with reference to the accompanying drawings in which—

Figures 1A, 1B:
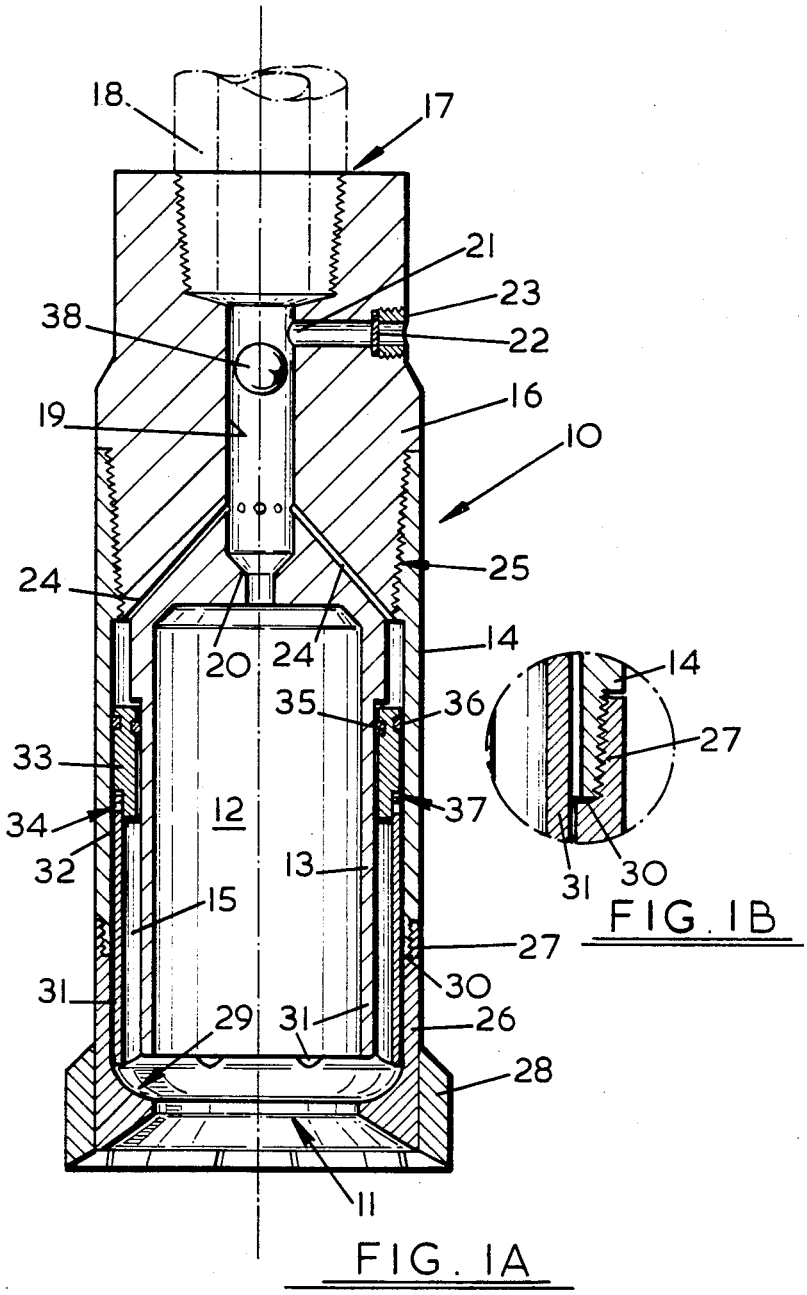
FIG. 1A is a sectional elevation of a retrieving device in accordance with the present invention and prior to the device having been actuated.
FIG. 1B is a detail of FIG. 1A to a larger scale than FIG. 1A.

In the drawings, the retrieving device consists of a body which is indicated generally by reference numeral 10 and is of generally hollow cylindrical configuration having an open end 11 giving access to the interior 12 of the body. The body 10 is defined by wall means in the form of mutually concentric inner and outer walls 13 and 14 respectively which in turn define between them an annular space 15.

The inner wall 13 is formed integrally with an upper body portion 16 adapted at 17 to receive the screw-threaded end of a drill string 18. The upper body portion or tool head 16 defines a main fluid circulating passage 19 which places the drill string 18 in communication with the tool interior 12 by way of a valve seat 20. The passage 19 communicates with a port 21, the outer portion of which is adapted to receive a pressure limiting device in the form of a pressure shear disc 22 located by a hollow screwed plug 23. The passage 19 is in communication with the annular space 15 by way of a plurality of ducts 24 each of which extends from the uppermost end of the annular space 15 and enters the passage 19 just above the valve seat 20.

The outer wall 14 is mounted on the tool head 16 by way of screw-threads 25. The lower end of the outer wall 14 is constituted by a detachable shoe 26 which is secured to the remainder of the outer wall 14 by means of screw-threads 27. The outer periphery of the shoe 26 is provided with cutting teeth 28, and the inner surface of the shoe 26 defines deflecting means in the form of a cupped surface 29. The cupped surface 29 merges with the cylindrical upper portion of the inner surface of the shoe 26, and the inside diameter of the upper portion of the shoe is less than the inside diameter of the remainder of the outer wall 14 so that an internal step is defined as indicated by reference numeral 30.

Figure 4:
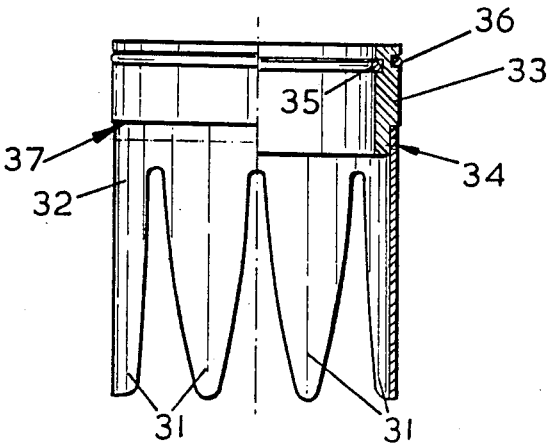
FIG. 4 is a part-sectional elevation, to a slightly larger scale, of parts of the device of FIG. 1A.

Within the annular space 15, there are disposed finger-like elements 31, best seen in FIG. 4, these elements being formed on a sleeve 32 made of high tensile aluminum. The sleeve 32 is relatively loosely disposed within the annular space 15, and the tips of the fingerlike elements 31 are located approximately at the junction of the inner cylindrical surface and the cupped surface 29 of the shoe 26. The upper end of the sleeve 32 engages an annular piston 33 on a stepped portion thereof and is secured (for convenience of assembly) by means of socket screws 34. The annular piston 33 is a sliding fit with respect to the facing surfaces of the inner and outer walls 13 and 14, and is provided with inner and outer annular seals in the form of replaceable O-rings 35 and 36. The external diameter of the annular piston 33 is slightly greater than the external diameter of the sleeve 32 so that an external step is defined as at 37.

Operation of the retrieving device described above is as follows. The device is run as a conventional washover type junk sub. The device, mounted on the end of the drill string or pipe string 18 is run down a hole. Rotation of the device is not necessary, and the provision of the cutting teeth 28 merely provides the option of effecting a cutting operation if required. When the operator is satisfied that the device has been worked to the hole bottom and the object to be retrieved worked so as to lie within the body of the device, an obstructor in the form of a valve ball 38 is released or dropped from the surface either from flow diverter ball release valve (not shown) which is made up in a Kelly gooseneck bull plug, or the Kelly is removed and the valve ball is dropped directly into the string 18. When the valve ball 38 lands on the valve seat 20, fluid flow is diverted through the ducts 24 to apply fluid pressure above the annular piston 33. The result is that the annular piston 33 is forced downwards forcing the finger-like elements 31 past the deflecting cupped surface 29 which deflects the finger-like elements 31 inwards (see FIGS. 5–7). The free end of the inner wall 13 disposed adjacent the deflecting means serves as an abutment engageable by the insides of the finger-like elements 31 (see FIGS. 6 and 7).

Figure 5:
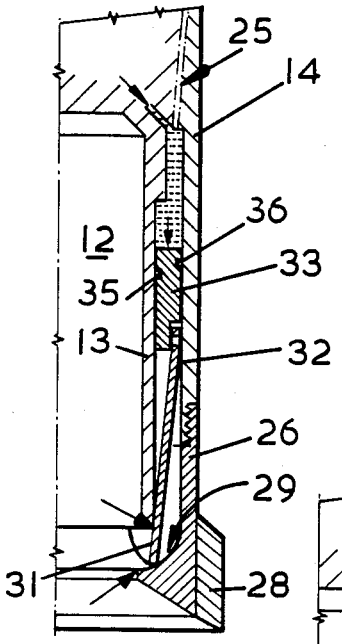
FIGS. 5–7 are sequential sectional details illustrating the closing of the finger-like elements during operation of the retrieving device.
Figure 6:
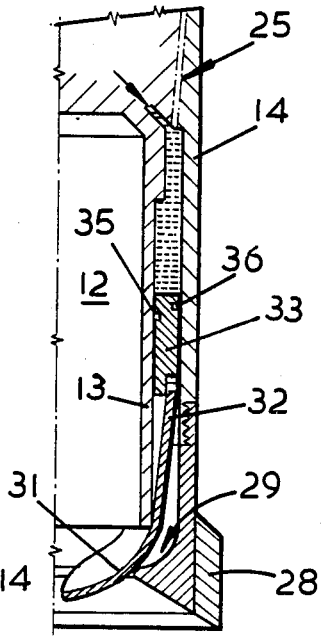
Figure 7:
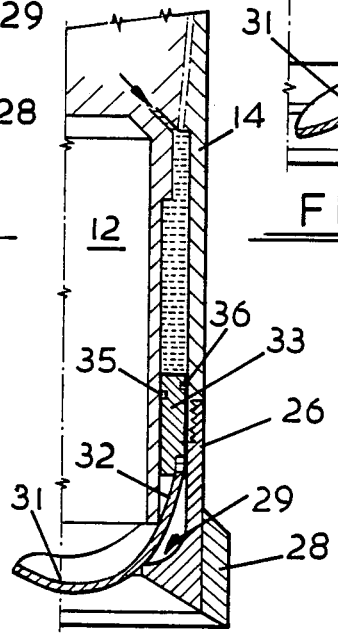

FIGS. 5–7 of the drawings illustrate the finger-like elements 31 at the start of the closing sequence, partly closed and fully closed, respectively. In FIG. 5, the datum points in the curve formation of the finger-like elements 31 are illustrated and one of these is the free end of the inner wall 13, while the other is the end of the deflecting cup surface 29. It can be seen that the tip portions of the finger-like elements 31 are barely curved (if at all) while the mid-portions of the finger-like elements 31 are permanently set to a smaller curvature. Since the finger-like elements 31 are not given any permanent set until some travel of the annular piston 33 has occurred, it is to be expected that the mid-portion of the finger-like elements 31 will be set to a smaller radius of curvature than the tip portions. In fact, the tip portions will barely be set at all.

Figure 2:
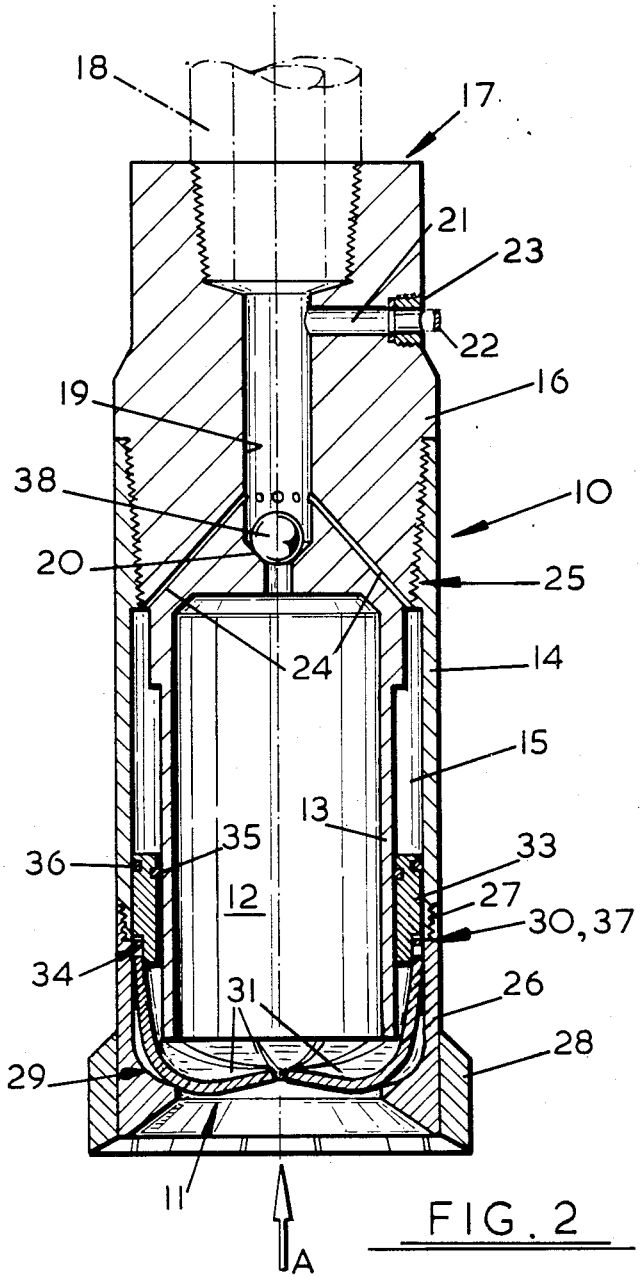
FIG. 2 is a sectional elevation similar to FIG. 1A, but subsequent to the device having been actuated.
Figure 3:
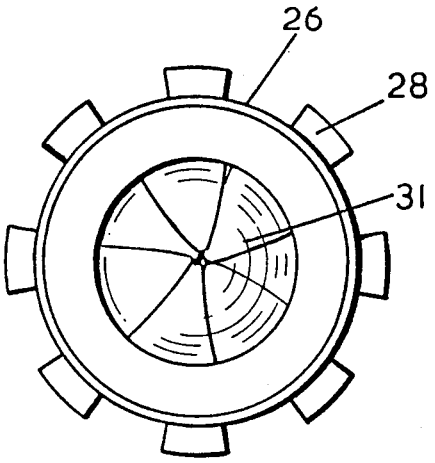
FIG. 3 is an end view in the direction of arrow A in FIG. 2.

Since the sleeve 32 and its finger-like elements are made of a malleable material, the finger-like elements are given a permanent set and so are re-configured to define closure over the open end 11 of the tool body, thus trapping whatever lies within the tool. As shown in FIGS. 2 and 7, in the closed condition of the device, the tip portions of the finger-like elements 31 are directed towards the interior 12 of the body 10. When the step 37 of the piston 33 and sleeve 32 assembly lands on the step 30 of the shoe 26, continuing supply of fluid results in a pressure increase until the pressure limiting device 22 ruptures or shears to release fluid through the port 21. Thereafter, the retrieving device can be pulled dry from the well with the retrieved object trapped within the interior 12 of the device.

For further use, the tool is dismantled and the reconfigured sleeve 32 disposed of and a fresh sleeve fitted to the annular piston 33.

The fishing tool or junk retriever is designed to recover junk from oil, gas and water wells. The primary use of the junk retriever is to recover junk from the bottom of a well. However, since the tool does not depend upon rotation to achieve the retrieval, it can be used to recover debris from ultra sensitive locations such as down hole packers, tops of well heads, liner hangers, and closed blow-out prevent rams, etc.

In the drawings and specification, there has been set forth a preferred embodiment of the invention, and although specific terms are employed, they are used in a generic and descriptive sense only and not for purpose of limitation.

What is claimed is:

1. A retrieving device for use in retrieving objects from wells, comprising a body of generally hollow cylindrical configuration, means defining an open end of said body giving access to the interior of said body, a head portion of said body disposed opposite the said open end, a hollow cylindrical wall extending from said head portion concentrically within said body and defining therewith an annular space, a sleeve member in said annular space, finger-like elements formed on said sleeve member and directed towards said open end, said finger-like elements being of a malleable material, said sleeve together with said finger-like elements being free to rotate with respect to said body, means for forcing the sleeve together with the finger-like elements towards said open end, and deflecting means within said body adjacent said open end for deflecting said finger-like elements inwards, a free end of said hollow cylindrical wall being disposed adjacent said deflecting means for cooperating with said deflecting means to effect permanent closure formation of the finger-like elements.

2. A retrieving device according to claim 1, wherein said forcing means comprises an annular piston disposed in said annular space, duct means defined in said head portion in communication with said annular space for conducting pressure fluid thereto, and a pressure limiting device disposed in said head portion and associated with said duct means.

3. A retrieving device according to claim 2. wherein said sleeve member is detachably secured to said annular piston.

4. A retrieving device according to claim 1, wherein said finger-like elements are made of high-tensile aluminum.

5. A retrieving device according to claim 1, wherein tip portions of said finger-like elements are directed towards the interior of the body in the closed condition of said device.

* * * * *